US005765240A

United States Patent [19]

Workman

[11] Patent Number: 5,765,240

[45] Date of Patent: Jun. 16, 1998

[54] SPRING BEDDING PRODUCT COLLAPSIBLE IN THE TRANSVERSE DIRECTION, AND METHOD OF MAKING IT

[75] Inventor: Joe C. Workman, Carthage, Mo.

[73] Assignee: L&P Property Management Co., Chicago, Ill.

[21] Appl. No.: 690,572

[22] Filed: Jul. 31, 1996

[51] Int. Cl.[6] ..... F16F 3/00; A47C 23/00

[52] U.S. Cl. ..... 5/247; 5/249; 267/103; 267/108; 267/110

[58] Field of Search ..... 5/246, 247, 249, 5/250, 255; 267/103, 108, 110; 29/91.1

[56] References Cited

U.S. PATENT DOCUMENTS

| | | | |
|---|---|---|---|
| 317,922 | 5/1885 | Bulkeley et al. . | |
| 332,082 | 12/1885 | Jeffery et al. . | |
| 1,040,693 | 10/1912 | Kohler . | |
| 1,476,046 | 12/1923 | Brandel et al. . | |
| 2,373,775 | 4/1945 | Neely et al. . | |
| 2,462,539 | 2/1949 | Neely et al. | 5/247 |
| 2,470,930 | 5/1949 | Jasinski | 5/175 |
| 2,968,818 | 1/1961 | Petersen . | |
| 3,708,809 | 1/1973 | Basner | 5/249 |
| 4,377,279 | 3/1983 | Schultz Jr, et al. | 5/247 |
| 4,654,905 | 4/1987 | Miller | 5/249 |
| 4,662,011 | 5/1987 | Duvivier | 5/246 |
| 4,771,995 | 9/1988 | Wells et al. | 5/247 |
| 5,346,188 | 9/1994 | Rodgers et al. | 5/247 |
| 5,370,373 | 12/1994 | Bruner et al. | 267/105 |
| 5,540,418 | 7/1996 | Miller | 5/255 |
| 5,622,357 | 4/1997 | Schulz, et al. | 5/247 |

FOREIGN PATENT DOCUMENTS

| | | | |
|---|---|---|---|
| 351736 | 4/1922 | Germany | 5/249 |
| 475144 | 4/1929 | Germany | 5/247 |
| 573463 | 3/1933 | Germany . | |

*Primary Examiner*—Alexander Grosz
*Attorney, Agent, or Firm*—Wood, Herron & Evans, L.L.P.

[57] ABSTRACT

A bedding product comprising a collapsible spring assembly, a pad covering the spring assembly and a fabric covering encasing the padded spring assembly. The spring assembly comprises a plurality of collapsible spring modules connected to a plurality of spaced parallel connecting rods and locking means to hold the assembly in an expanded condition and prevent its collapse. The parallel connecting rods are located between border rods in the top and bottom planes of the assembly. Each of the spring modules comprises four individual wires joined together with helical lacing wire wrapped around a center section of each of the wires. The center sections of the wires define an axis about which each of the wires are capable of rotational movement. Upon the collapse of the assembly, each of the spring modules collapses rotating around the axis of the module. The assembly is held in an expanded condition by a plurality of locking rods, pieces of plastic mesh or other locking means.

34 Claims, 7 Drawing Sheets

SPRING BEDDING PRODUCT COLLAPSIBLE IN THE TRANSVERSE DIRECTION, AND METHOD OF MAKING IT

FIELD OF THE INVENTION

The present invention relates to bedding products and more particularly to a collapsible spring assembly for use in a bedding product.

DESCRIPTION OF THE PRIOR ART

Spring assemblies for mattresses and box springs are typically made up of rows and columns of individual coil springs connected together with individual clips or helical lacing wires. Each coil spring usually has a top and bottom end turn, and a plurality of helical convolutions therebetween defining a spring axis. The top and bottom end turns of the coil springs are generally interconnected in the top and bottom planes of the mattress and in the top plane of a box spring. Border wires may surround the assembly and be connected to the outer edge of the assembly.

Typically these spring assemblies are fully assembled before being shipped to a manufacturer's upholstery plant for placement of a pad over the planar surface(s) of the spring assembly and then being covered with a fabric upholstery.

These spring assemblies are typically shipped to the manufacturer using a technique called baling. A bale is several compressed fully assembled spring assemblies stacked one on top of another. The stack is covered at the top and bottom with a rigid piece of plywood or other suitable material for protection or support. The bale is tied together with two or more heavy encompassing wires to prevent lateral movement of individual mattress spring assemblies. The heavy encompassing wires are bound tightly in an effort to compress the individual spring assemblies so the assemblies cores take up as little shipping space as possible.

Upon arrival at the manufacturer's upholstery plant, the heavy encompassing wires must be removed in order to remove the individual spring assemblies for further processing. Because the heavy encompassing wires are under high tension, disassembling a bale of compressed innerspring cores is expensive and slow.

In addition to the expense associated with baling together a group of individual spring assemblies for shipping, another problem is that the spring assemblies are bulky and space consuming. Absent the compression caused by the tight encompassing wires, each individual spring assembly takes up as much room as it would fully assembled at rest. When the bales are shipped to an upholstery manufacturer relatively few bales of fully assembled spring assemblies are able to fit inside the truck or other mode of transportation. Therefore, using baling as a means of packing innerspring assemblies for shipment is inefficient and costly.

One solution to this bulkiness problem has been to manufacture a bedding product which is collapsible and may be shipped in a collapsed condition. Upon arrival at the manufacturer's facility the bedding product is erected and assembled. Such a bedding product in its collapsed condition takes up less space than a fully assembled bedding product and with a minimum of effort may be erected at the manufacturer's facility before being completed with the addition of padding and upholstery.

Most of these collapsible bedding products have a top wire grid spaced above a bottom wire grid and a plurality of support members extending between the grids. The support members extending between the grids are hingedly connected to the top and bottom grids so as to enable the assembly to collapse in order to reduce the depth or height of the assembly. Upon the collapse of the assembly, each of the support members moves in the same direction enabling the grids to move closer together.

U.S. Pat. No. 4,377,279 discloses one such collapsible bedding product which is movable between an erect and retracted position. The box spring of this patent has a wire foundation which may be shipped in a collapsed condition and upon arrival at the manufacturer's facility erected before being covered with padding and upholstery. The support members of the wire foundation are held, once erected, in a fully expanded state by a plurality of struts which extend between the top grid and the wooden frame of the box spring. The struts are stapled to the wooden cross bars of the frame of the box spring so that once the wire foundation is erected and the struts stapled in place the box spring is no longer collapsible.

U.S. Pat. No. 4,654,905 also discloses a collapsible bedding product which is foldable between a collapsed position and an erected position. The product may be used as a box spring or a mattress, but in either case the height of the product may be reduced due to the collapsibility of the product. The product comprises two separate connected sections which may be folded one upon the other. The product is shipped in its collapsed position with the two sections folded upon each other. Upon arrival at the manufacturer's facility, the product is unfolded into an erected position. The unfolding of the product moves the support members of both sections from their collapsed positions to their erected positions and maintains them that way until the product is folded again.

One other way bedding products have been collapsed for shipment has been to reduce the length or width of the product rather than the height of the product. U.S. Pat. No. 332,082 discloses a bed bottom comprising a plurality of longitudinally extending slats. On each slat are a plurality of spaced coil springs. The slats of the bed bottom are movable toward one another in order to collapse the assembly and reduce the width of the assembly. Upon the collapse of the assembly, the springs of one row are able to fit between the spaced springs of the adjacent rows, enabling the assembly to collapse and the slats to move together. A plurality of hinge locks extend between the slats and are able to lock the slats apart from one another when the assembly is in an erected condition. Although this type of assembly does reduce the space necessary for shipment by its capability to collapse, each hinge lock must be separately locked and unlocked in order to erect or collapse the assembly. This requires a great deal of time, is very labor intensive and makes assembly at the manufacturer's facility after shipping very labor intensive and hence expensive.

Another bed bottom which is collapsible in a transverse direction is U.S. Pat. No. 317,922, which discloses two transversely extending accordion type tongs, one located on each end of the bed bottom. A plurality of spiral springs extending in a longitudinal direction of the bed bottom are secured to the tongs. Outside the spiral springs are two opposed longitudinally extending siderails. In order to collapse the bed bottom the siderails are moved toward one another closing the accordion type tongs and moving the spiral springs closer together. One drawback to this type of bed bottom is that there is no support between the spiral springs when the bed bottom is expanded so the bed bottom will not support a great deal of weight. Also upon a large load the spiral springs may disengage from the tongs.

Therefore, it has been one objective of the present invention to provide a collapsible bedding product which is collapsible in a transverse direction.

It has been a further objective of the present invention to provide collapsible bedding product which is less costly to manufacture than heretofore known collapsible assemblies.

It has been a further objective of the present invention to provide a bedding product comprising a plurality of collapsible modules, each module being collapsible in and of itself.

It has been a further objective of the present invention to provide a collapsible spring assembly which may be quickly and easily erected at a manufacturing facility prior to being incorporated into a bedding product.

It has been a further objective of the present invention to provide a spring assembly which may occupy less space during shipping than prior collapsible spring assemblies.

SUMMARY OF THE INVENTION

The invention of this application which accomplishes these objectives comprises a bedding product made up of a plurality of collapsible spring modules, which modules when assembled and erected, make up with the interior spring assembly of a mattress or box spring.

The spring assembly comprises a plurality of collapsible spring modules, a plurality of spaced parallel connecting rods, and a plurality of tie rods which serve to lock and hold the spring assembly in an expanded or erected position and prevent its collapse. When erected, the spring assembly has an upper planar surface in a top plane and a lower planar surface in a bottom plane with the parallel connecting rods being located in the top and bottom planes. Each of the spring modules is secured to a pair of connecting rods in the top plane and a pair of connecting rods in the bottom plane. The connecting rods are movable together when the assembly is collapsed and are retained in a spaced apart relationship when the assembly is in an erected condition.

Each of the spring modules comprises four individual wires joined together at a center section of each of the wires. The center sections of the wires define an axis about which each of the wires are capable of rotational movement. Each individual wire of the spring module has a horizontal center section, two diverging connecting sections extending away from opposite ends of the center section and two end sections substantially parallel to the center section and extending outwardly from the connecting sections. The end sections of the individual wires of the modules are fastened to the connecting rods of the assembly using helical lacing wire, a clip or any other type of conventional fastener. The four individual wires of each module are pivotally connected together with a piece of helical lacing wire encircling the center sections of the four wires, allowing the individual wires of the modules to pivot or rotate about the axis of the module without separating from one another.

The endmost connecting rods which may be referred to as border rods are preferably of heavier gauge wire than the intermediate connecting rods so as to impart stability and strength to the assembly. The outermost spring modules are attached to these endmost connecting rods by means of sheet metal clips or any other conventional fasteners in the same manner that the intermediate spring modules may be attached to the connecting rods.

In use, in order to erect the spring assembly of the present invention from a collapsed condition, the endmost connecting rods or border rods are pulled apart in each of the planes of the assembly thus enabling each of the spring modules to expand and cause the connecting rods to distance themselves from one another in the top and bottom planes of the assembly. Once erected, one or more locking rods may be secured to the border rods of the assembly in order to maintain the assembly in an erected condition and prevent its collapse. Typically two locking rods are at each end edge of the assembly, one in each planar surface of the assembly. An alternative to the locking rods is a plastic mesh of semi-rigid plastic which functions to maintain the assembly in an erected condition. Like the locking rods, the plastic mesh is secured to the border rods of the assembly and prevents the border rods from moving toward one another.

Additionally, a wire mesh may be secured to one of the planar surfaces of the assembly above or below the connecting rods in order to prevent the pad or fabric covering from slipping between the connecting rods when the assembly is in use.

The capability of each of the spring modules to rotate about an axis enables each of the modules to collapse easily and without a great deal of force being applied thereto. One by one the spring modules collapse as the connecting rods are moved together when one pushes the endmost connecting rods or border rods together in order to collapse the assembly. Likewise, when the assembly is erected one by one the spring modules rotate open as the border rods are pulled apart until they are all erected. Once erected, either locking rods or lengths of plastic mesh are connected to the border rods ensuring that the assembly will not collapse. The capability of this assembly to be erected quickly and easily by simply pulling the border rods apart and attaching either locking rods or some other form of locking means to the border rods of the assembly enables one to transform the assembly into an erected condition quickly, easily and at low cost. The transformation of the spring assembly of the present invention from a collapsed condition to an erected condition at the manufacturing facility does not require a great deal of effort and time and therefore is cost effective. Being able to ship the assemblies in a collapsed condition and not have to expend a great deal of time or money at the manufacturing facility once the assemblies arrive in erecting them is a very desirable feature of the present invention and will enable more bedding products to be shipped in one truck or other mode of transportation than has heretofore been possible.

These and other objects and advantages of this invention will become more readily apparent from the following description of the drawings in which:

DETAILED DESCRIPTION OF THE DRAWINGS

Figure 1:
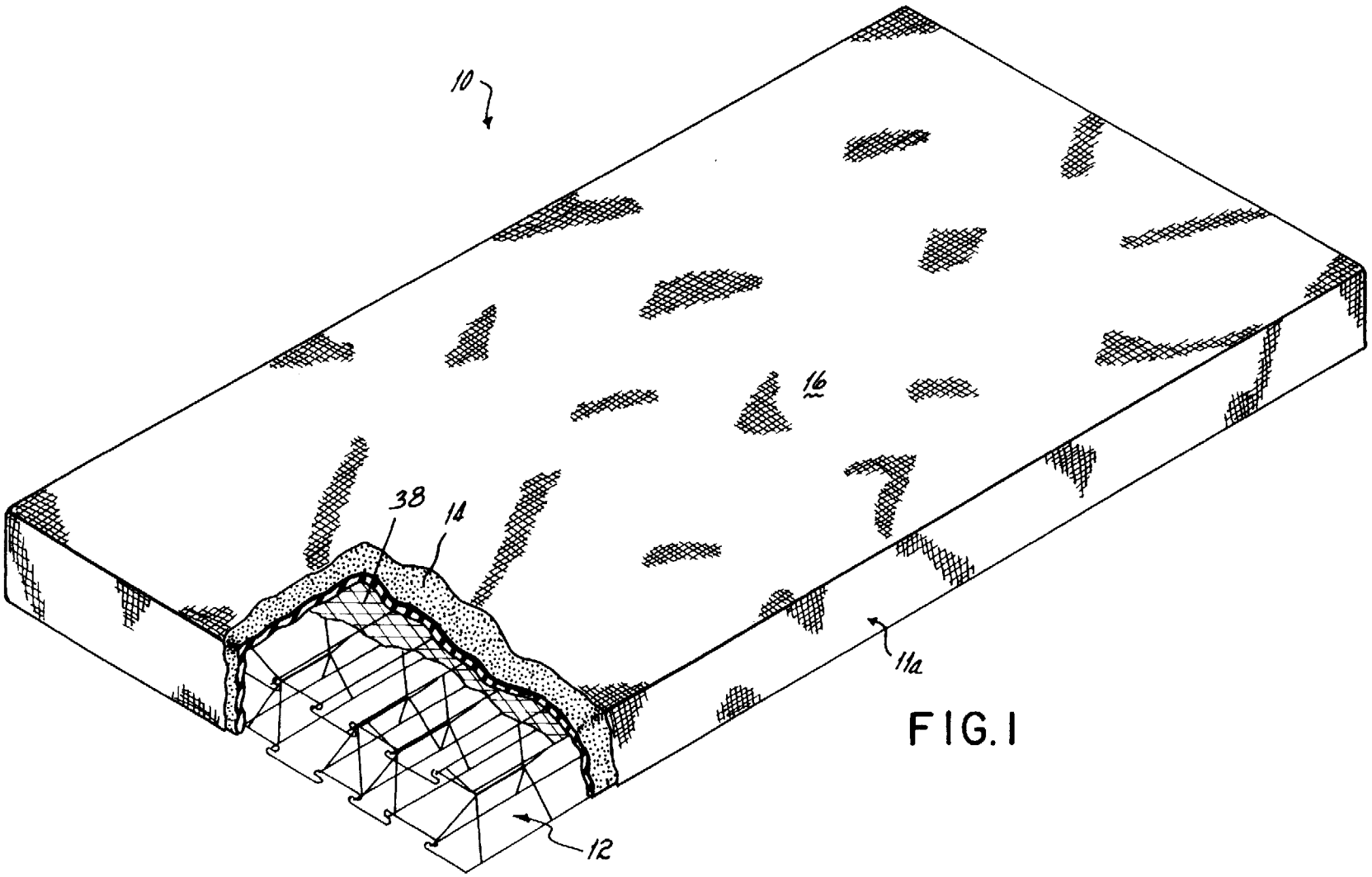
FIG. 1 is a perspective view, partially broken away of a mattress incorporating the collapsible spring assembly of the present invention.
Figure 8:
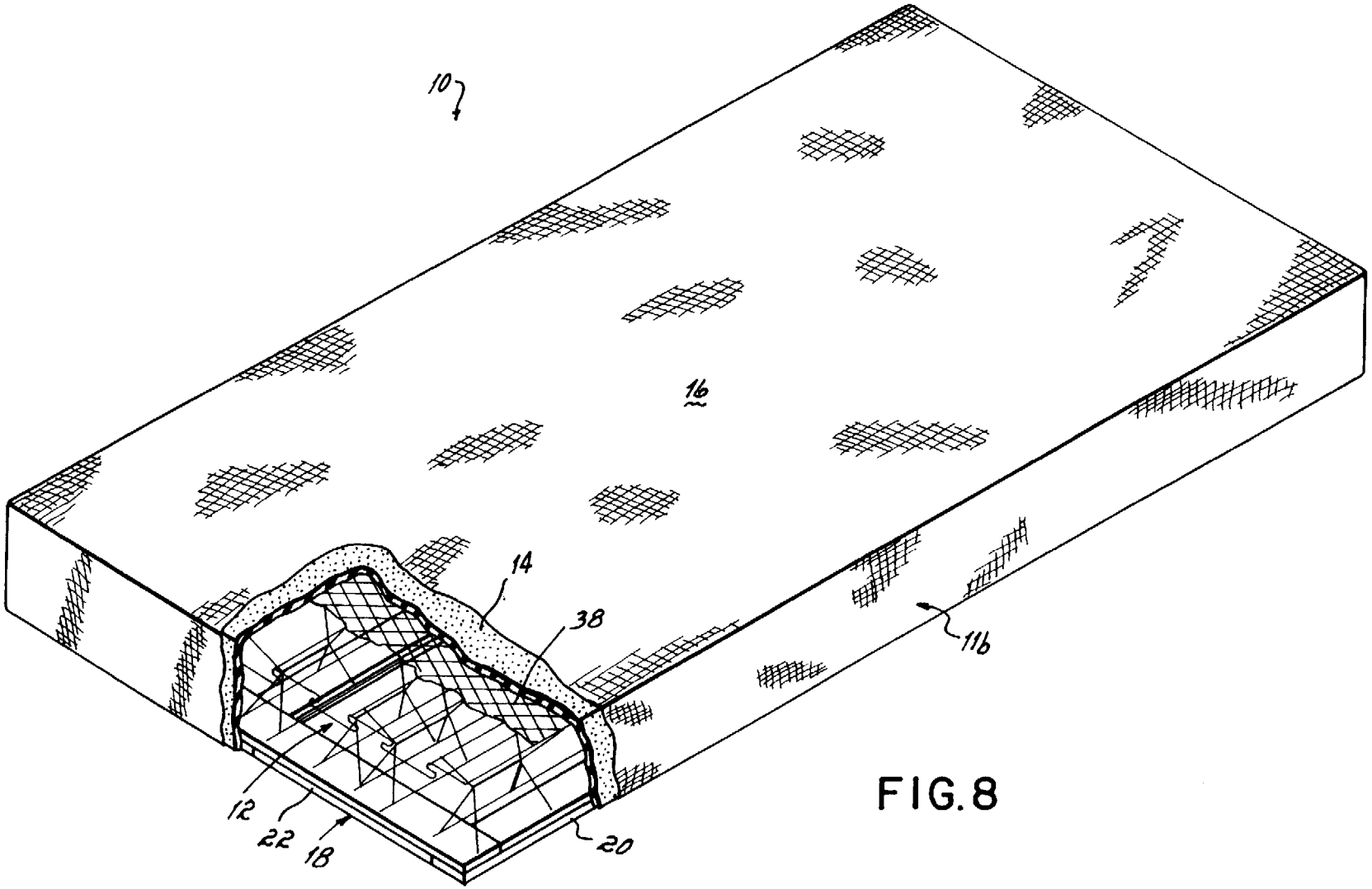
FIG. 8 is a partially broken away perspective view of a box spring incorporating the spring assembly of the present invention.

As illustrated in FIGS. 1, the bedding product 10 of the present invention comprises a collapsible spring assembly 12, a pad 14 covering one surface of the spring assembly and an upholstered fabric covering 16 encasing the pad 14 and spring assembly 12. The bedding product 10 may be either a mattress 11*a* as illustrated in FIG. 1 or a box spring 11*b* as illustrated in FIG. 8. The box spring 11*b* of FIG. 8 has secured to the bottom of the spring assembly 12 a wooden frame 18 comprising a plurality of longitudinally extending wooden slats 20 secured to two transversely extending end slats 22. In the case of a box spring the fabric covering 16 surrounds not only the spring assembly 12 and pad 14, but also the wooden frame 18 of the box spring.

The spring assembly 12 of the present invention is collapsible and has an upper planar surface 24 in a top plane 26 and a lower planar surface 28 in a bottom plane 30. The spring assembly 12 comprises a plurality of collapsible modules 32, each module 32 extending between said top and bottom planes 26, 30. Each module 32 comprises four individual wires 54 with each individual wire 54 being configured identically and being held together in an assembled relationship by means of a length of helical lacing wire 58. The modules 32 are connected to a plurality of parallel connecting rods 34 which are located in the top and bottom planes of the assembly 26, 30. The connecting rods 34 are not secured to anything other than the modules 32 themselves so that the connecting rods 34 are free to move laterally as the spring assembly is collapsed and expanded.

In order to secure the assembly in an expanded condition and prevent its collapse, one preferred embodiment of the assembly utilizes a plurality of locking rods 36 (see FIG. 2) located in the top and bottom planes 26, 30 of the assembly. Preferably four locking rods 36 are utilized, two on each end of the assembly, one located in the top plane 26 and the other located in the bottom plane 30 of the assembly at each end of the assembly.

Figure 2:
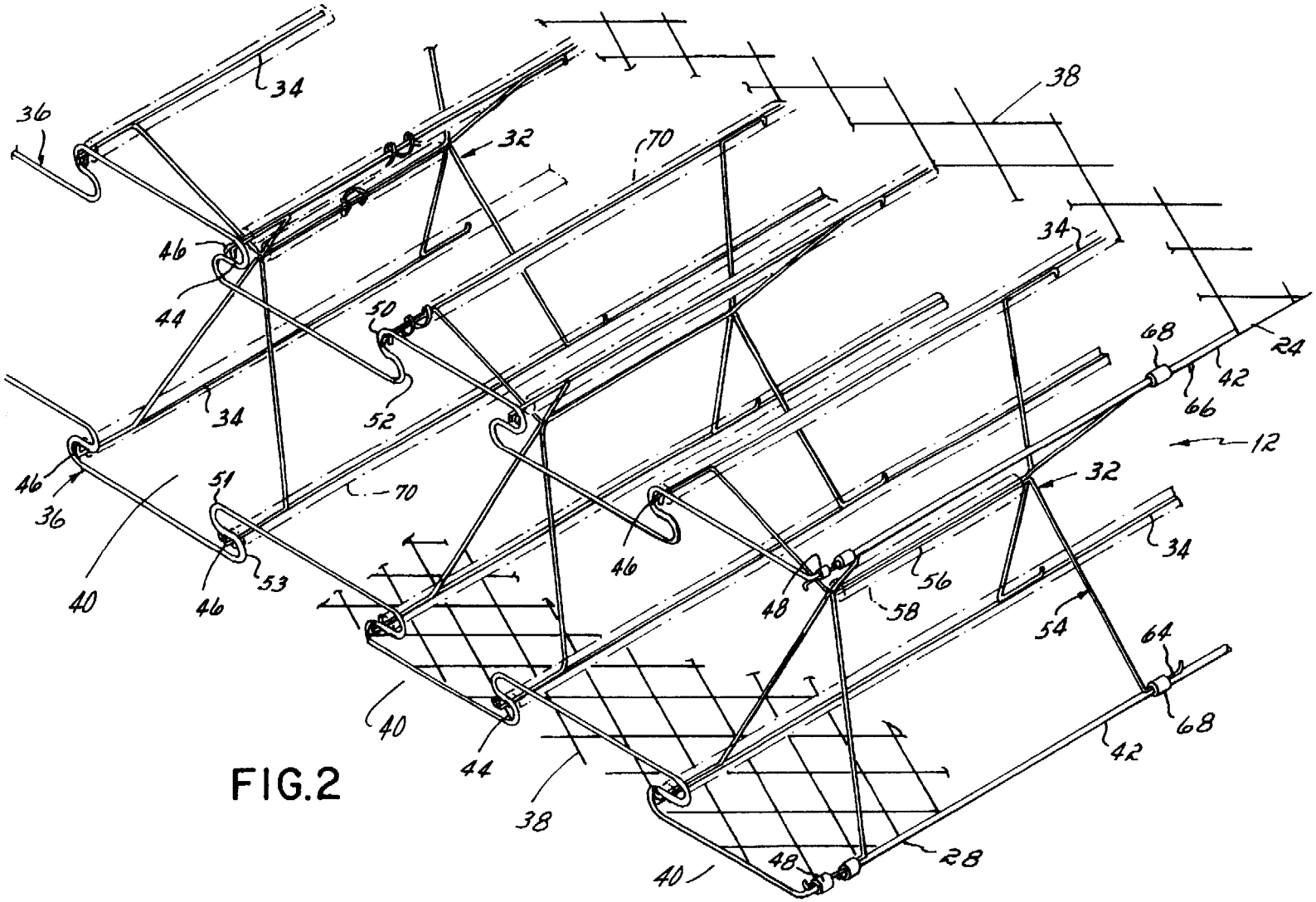
FIG. 2 is an enlarged view of the exposed portion of FIG. 1.

As illustrated in FIG. 2 a mesh net 38 may be placed on top of one or both of the planar surfaces 24, 28 of the assembly in order to prevent the pad 14 and fabric covering 16 from passing between the connecting rods 34 of the assembly.

As illustrated in FIG. 2, the modules 32 of the assembly are aligned in longitudinally extending rows 40 such that the same portions of each of the modules within a row are connected to the same connecting rods at longitudinally spaced locations. In the preferred embodiment, the individual wires 54 of each of the modules 32 are secured to the connecting rods 34 by means of helical lacing wires 70.

At the ends of the spring assembly are endmost connecting rods or border rods 42 which extend longitudinally of the assembly parallel to the other connecting rods 34 in the top and bottom planes 26, 30 of the assembly. These endmost connecting rods or border rods 42 are typically of a heavier gauge wire than the connecting rods and provide stability to the unit. The assembly may be collapsed by pushing the border rods 42 together and expanded by pulling the border rods 42 apart.

Figure 3:
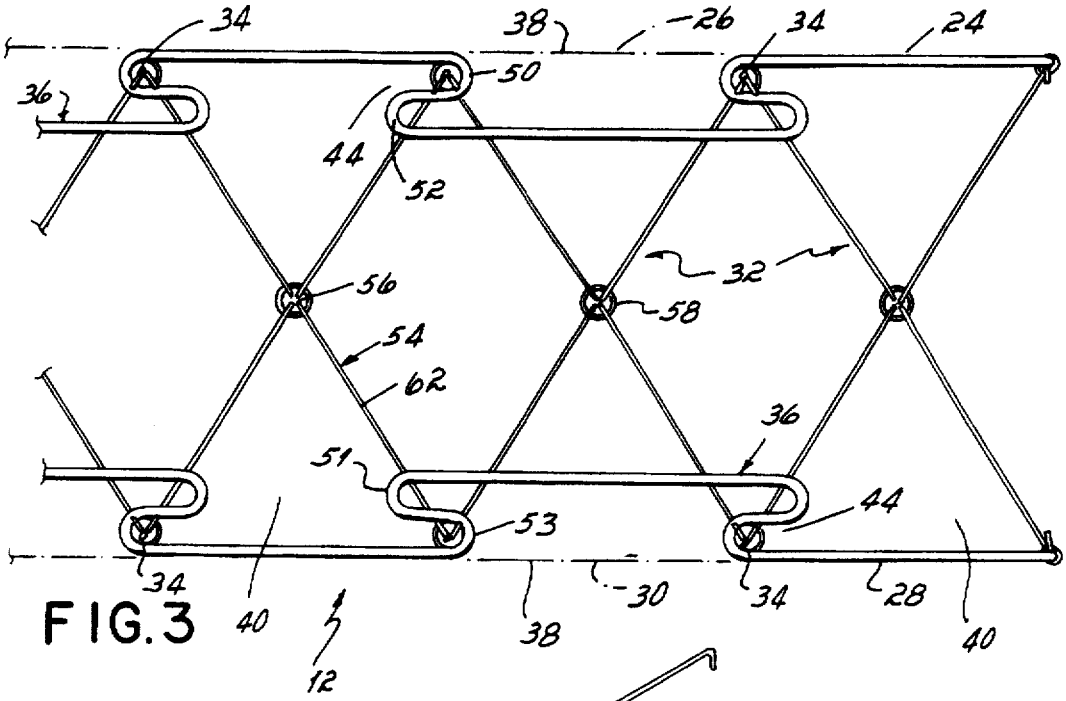
FIG. 3 is an elevational end view of a portion of the spring assembly of the present invention in an erected condition.

The locking rods 36 extend transversely of the assembly at the ends thereof. As best illustrated in FIG. 3, the locking rods 36 are not linear but have a plurality of dovetail shaped recesses 44 formed therein which enable the locking rods 36 to wrap around the end portions 46 of the connecting rods 34 so as to prevent lateral movement of the connecting rods 34 when the assembly is in an erected condition. The ends of the locking rods 36 are secured to the endmost connecting rods or border rods 42 by means of fasteners 48 which may be sheet metal clips or hog rings or any other conventional fasteners. So connected, the locking rods define the width of the spring assembly and prevent further lateral expansion of the erected spring assembly.

The recesses 44 of the locking rods receive the end portions 46 of the connecting rods 34 to define the width of the individual modules when erected and to prevent inward collapse of the modules when a load is placed atop the erected spring assembly and the erected spring assembly is compressed. As best illustrated in FIG. 3, each of the locking rods 36 located in the top plane 26 has a plurality of recesses 44 defined by upper 180° reverse curves 50 which wrap around the connecting rods 34 and a plurality of lower 180° reverse upper curves 52 which curve in opposite directions so that the two curves 50 and 52 when viewed from the end are "S" shaped. Similarly, the locking rods 36 located in the bottom plane 30 of the spring assembly have a plurality of recesses 44 defined by two sets of curves, an upper set of 180° curves 51 and a lower set of oppositely directed 180° curves 53 with the lower set of curves 53 being wrapped around connecting rods 34 located in the bottom plane 30 of the assembly. The curves in the upper and lower locking rods 36 are identically shaped but are inverted relative to one another so that the lower curves 53 of the lower locking rod prevent lateral movement of the connecting rods 34 in the bottom plane 30 of the assembly and the upper curves 50 of the upper locking rod prevent lateral movement of the connecting rods 34 located in the top plane 26 of the assembly.

Figure 5:
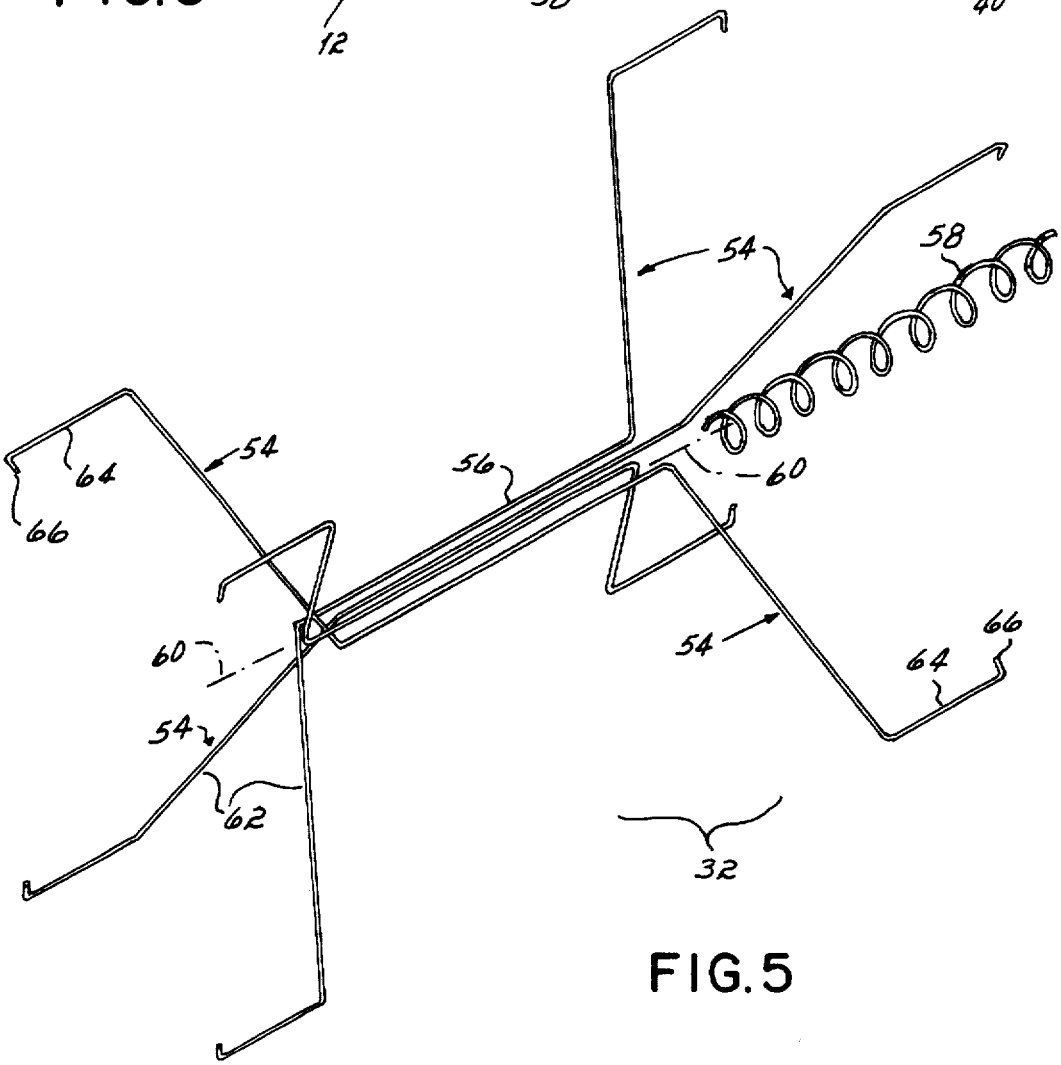
FIG. 5 is an exploded perspective view of one spring module of the spring assembly of FIG. 1.
Figure 4:
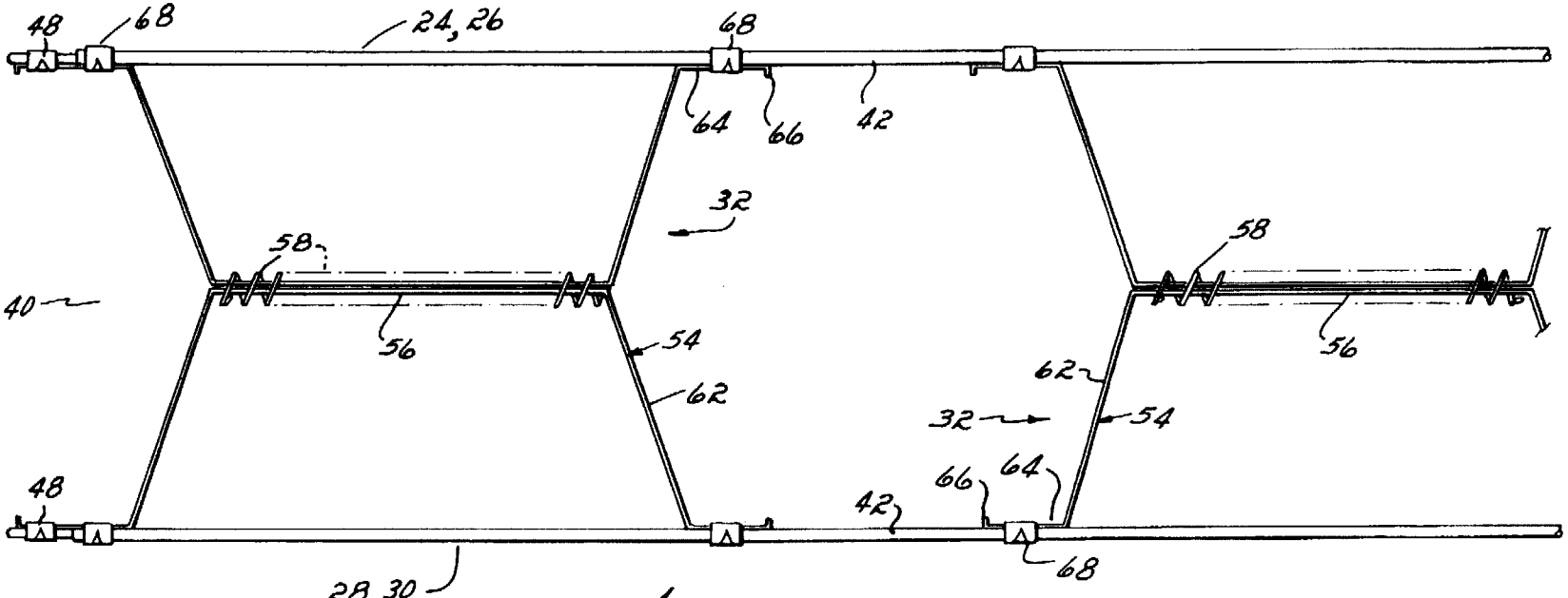
FIG. 4 is a side elevational view of a portion of the spring assembly of the present invention.

As best illustrated in FIG. 5, each of the spring modules 32 comprises four individual identically shaped wires 54. The wires are joined together about a center section 56 of each of the wires by means of a length of helical lacing wire 58 so as to define an axis 60 of the assembled module. In addition to a center section 56, each of the wires 54 has two diverging connecting sections 62 which extend away from opposite ends of the center section 56 in opposite directions. Each of the wires 54 further has two end sections 64 which are substantially parallel to the center section 56 and extend outwardly and away from the outer ends of the connecting sections 62. Each end section 64 further has a tail section 66 which extends inwardly toward the middle of the module. The end section 64 of each wire 54 as illustrated in FIGS. 2 and 4, is secured to either a connecting rod 34 or a border rod 42 of the assembly by means of either helical lacing wires or clip type fasteners. With this construction each of the wires 54 is pivotable or rotatable about the axis 60 of the module, enabling each module to collapse individually. The four wires 54 of each module 32 do not separate from one another due to the helical lacing wire 58 encircling the center section 56 of each wire, as best illustrated in FIGS. 2 and 4. Upon collapse of each module 32 the connecting sections 62 and associated end sections 64 of each individual wire 54 move closer together as the center section 56 of each wire rotates about axis 60 inside the helical lacing wire 58.

Figure 6:
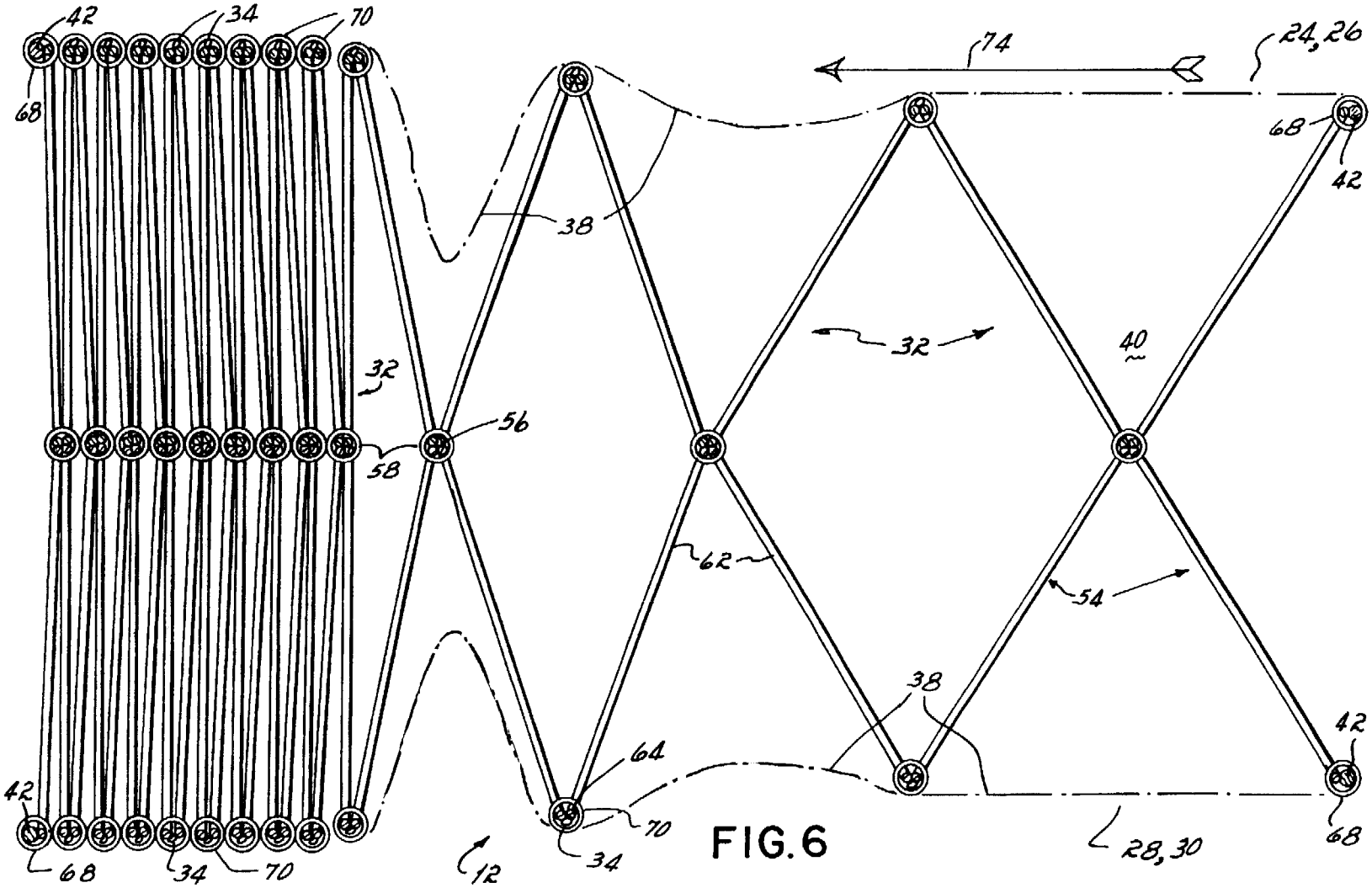
FIG. 6 is a diagrammatic cross sectional view of the spring assembly of the present invention illustrating how the spring assembly is collapsed.

As seen in FIG. 6, each of the modules 32 is collapsible about an axis 60 such that upon collapse of the assembly the connecting sections 62 of each of the modules come together in a near touching relationship. The helical lacing wires 70 in the top and bottom planes of the assembly come together into a touching relationship as do the helical lacing wires 58 surrounding the horizontal center sections of each of the module wires 54. An operator need simply push the endmost border rods 42 together in the direction of arrow 74 in order to collapse the assembly. Without the locking rods or any other locking means to prevent the collapse of the assembly, the assembly may be collapsed with a minimum amount of force applied to the border rods of the assembly in the top and bottom planes thereof.

Figure 7:
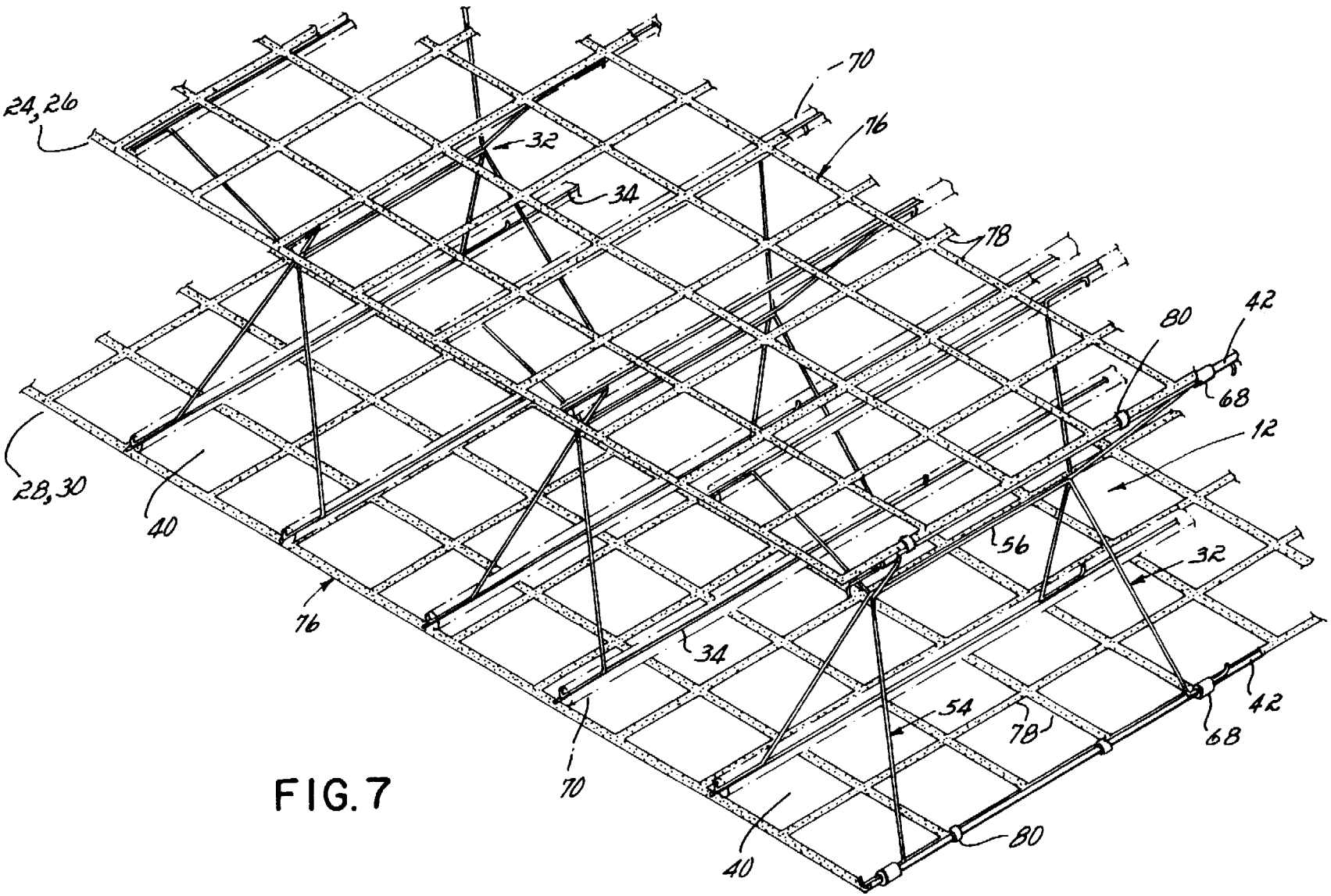
FIG. 7 is a perspective view of a corner of the spring assembly of the present invention incorporating an alternative embodiment of locking means to maintain the assembly in an erected condition.

FIG. 7 illustrates an alternative embodiment of the present invention in which a relatively rigid but flexible plastic mesh 76 is used in place of locking rods to hold the assembly in an expanded condition. The plastic mesh 76 is made up of criss-crossing plastic members 78 which form small squares or holes. The individual members 78 of the mesh 76 are of sufficient strength so that they will not bend absent extraordinary force applied to the edges of the plastic mesh 76. The plastic mesh 76 may cover the entire upper and lower planar surfaces of the assembly or alternatively may only extend over the full width but less than a full length at the ends of the assembly so as to prevent collapse of the assembly. The edgemost members 78 of the plastic mesh 76 are secured by hog rings or other conventional fasteners 80 to the border rods 42 of the assembly when the assembly is desired to be maintained in an expanded state. If the assembly is desired to collapse, the fasteners 80 may be removed and the plastic mesh 76 removed thereby enabling the individual modules to collapse. In order to save money and time, rather than have the plastic mesh 76 cover the entire top and bottom planar surfaces of the assembly, it is more desirable to have two pieces of plastic mesh, one at each end of the assembly, extending transversely of the assembly and secured to the border rods, but only extending approximately one foot from the edge of the assembly inwardly. With this embodiment of the present invention, locking rods 36 are not necessary and need not be utilized. However, the plastic mesh 76 may be utilized in conjunction with locking rods if one so desires.

FIG. 8 illustrates the spring assembly of the present invention utilized in a box spring. In this use, the end sections 64 of the individual wires 54 of the modules 32 located in the lower planar surface 28 of the assembly may be secured to connecting rods 34 by means of helical lacing wires 70 or the connecting rods may be omitted. If the connecting rods are omitted, the end sections 64 of the individual module wires 54 located in the lower planar surface 28 of the assembly are stapled or otherwise secured directly to the longitudinally extending slats 20 of the box spring frame 18. Alternatively, if the spring assembly includes the connecting rods in the lower planar surface, then the connecting rods may be secured to the slats 20 of the box spring. Utilizing the spring assembly of the present invention in a box spring, it is not necessary to have locking rods in the lower planar surface 28 of the assembly because the modules 32 are stapled and secured to the wooden frame 18 which functions to maintain the modules 32 in an expanded condition and prevent the collapse of the assembly. However, in the upper planar surface 24 of the assembly, locking rods or other locking means are necessary to secure the border rods 42 in a spaced apart relationship and maintain the assembly in an expanded condition.

While we have described only two embodiments of the present invention, those persons skilled in the art will appreciate changes and modifications which may be made while still practicing the invention of this application. Therefore, we do not intend to be limited except by scope of the following claims:

I claim:

1. A bedding product having a length and a width, said length being greater than said width, said bedding product comprising:

a collapsible spring assembly having a collapsible width, an upper planar surface in a top plane and a lower planar surface in a bottom plane, said spring assembly comprising:

a plurality of collapsible spring modules extending between said planes, a plurality of spaced, parallel straight connecting rods, said connecting rods being located in said top and bottom planes, said modules being secured to said connecting rods in said top and bottom planes, locking means for holding said assembly in an expanded position and preventing the collapse of said assembly, a pad covering a surface of said spring assembly, a fabric covering encasing said pad and spring assembly.

2. The bedding product of claim 1 further comprising a wire net covering at least one of said surfaces of said assembly beneath said pad, preventing said pad and fabric covering from passing between said connecting rods.

3. A bedding product comprising:

a collapsible spring assembly having an upper planar surface in a top plane and a lower planar surface in a bottom plane, said spring assembly comprising:

a plurality of collapsible spring modules extending between said planes, each spring module being collapsible about an axis, said axis being located between said top and bottom planes, a plurality of spaced, parallel connecting rods, said connecting rods being located in said top and bottom planes, said modules being secured to said connecting rods in said top and bottom planes, locking means for holding said assembly in an expanded position and preventing the collapse of said assembly.

4. The bedding product of claim 2 further comprising a wooden base secured beneath said spring assembly.

5. The bedding product of claim 3 wherein each spring module comprises a plurality of individual wires joined together at a center section of each of said plurality of wires and defining an axis about which said plurality of wires are capable of rotational movement between collapsed and erected conditions.

6. The bedding product of claim 3 wherein each spring module comprises four individual wires, each individual wire having a horizontal center section, two diverging connecting sections extending away from opposite ends of said center section, and two end sections substantially parallel to said center section, said end sections extending outwardly from said connecting sections.

7. A collapsible spring assembly having a longitudinal dimension and a transverse dimension, said longitudinal dimension being greater than said transverse dimension, an upper planar surface in a top plane and a lower planar surface in a bottom plane, said spring assembly comprising:

a plurality of collapsible spring modules, each of said spring modules being collapsible in a transverse direction and extending between said planes and being secured to at least one connecting rod of a plurality of parallel connecting rods, said connecting rods being located in said top and bottom planes, and means for holding said assembly in an expanded condition, preventing the collapse of said assembly.

8. The collapsible spring assembly of claim 7 further comprising two border rods in each of said planes between which lie said connecting rods.

9. The collapsible spring assembly of claim 8 wherein said assembly is held in an expanded condition by at least one locking rod located substantially in one of said planes, said locking rod being secured to said border rods in order to prevent the collapse of said assembly.

10. The collapsible spring assembly of claim 8 wherein said assembly is held in an expanded condition by a plastic net located substantially in one of said planes, said plastic net being secured to said border rods in order to prevent the collapse of said assembly.

11. The collapsible innerspring assembly of claim 7 wherein each spring module comprises a plurality of individual wires joined together at a center section of each of said plurality of wires and defining an axis about which said plurality of wires are capable of rotational movement between collapsed and erected conditions.

12. The collapsible spring assembly of claim 7 wherein each of said spring modules comprises four individual wires.

13. The collapsible spring assembly of claim 12 wherein said individual wires of said spring modules are joined together with helical lacing wire.

14. The collapsible spring assembly of claim 12 wherein each of said individual wires has a horizontal center section, two diverging connecting sections extending away from opposite ends of said center section, and two end sections substantially parallel to said center section, said end sections extending outwardly from said connecting sections.

15. A collapsible spring assembly having a longitudinal dimension and a transverse dimension, said longitudinal dimension being greater than said transverse dimension, an upper planar surface in a top plane and a lower planar surface in a bottom plane, said innerspring assembly comprising:

a plurality of collapsible spring modules extending between said planes, each spring module being collapsible about a longitudinally extending axis, a plurality of spaced, parallel connecting rods, said connecting rods being located in said top and bottom planes, said modules being secured to said connecting rods, four border rods parallel said connecting rods, two border rods being located in each plane, outside of said connecting rods, means for holding said assembly in an expanded condition and preventing the collapse of said assembly.

16. The collapsible spring assembly of claim 15 wherein said assembly is held in an expanded condition by at least one locking rod located substantially in one of said planes, said locking rod being secured to said border rods in order to prevent the collapse of said assembly.

17. The collapsible spring assembly of claim 15 wherein said assembly is held in an expanded condition by a plastic net located substantially in one of said planes, said plastic net being secured to said border rods in order to prevent the collapse of said assembly.

18. The collapsible spring assembly of claim 15 wherein each spring module comprises four individual wires joined together with helical lacing wire, the helical lacing wire of each module encircling a center section of each of said four wires and defining an axis about which said wires are capable of rotating.

19. The spring assembly of claim 18 wherein each of said wires of said modules has a center section, two diverging connecting sections extending away from opposite ends of said center section, two end sections substantially parallel to said center section, said end sections extending outwardly from said connecting sections and a tail section extending inwardly from each end section.

20. The collapsible spring assembly of claim 15 further comprising a wire net located in one of said planes and covering one of said surfaces of said assembly to prevent material from falling between said connecting rods.

21. The collapsible spring assembly of claim 15 wherein said modules are secured to said connecting rods by means of helical lacing wires, said helical lacing wires encircling said connecting rods.

22. A collapsible spring assembly having an upper planar surface in a top plane and a lower planar surface in a bottom plane, said assembly comprising:

a plurality of collapsible spring modules, each spring module comprising four individual wires secured together by helical lacing wire, each individual wire having a center section, two diverging connecting sections extending away from opposite ends of said center section, two end sections substantially parallel to said center section, said end sections extending outwardly from said connecting sections and a tail section extending inwardly from each end section, said helical lacing wire encircling said center sections of said four individual wires and defining an axis about which said wires are capable of rotating, a plurality of longitudinally extending spaced, parallel connecting rods, said connecting rods being located in said top and bottom planes, said end sections of said wires of said modules being secured to said connecting rods, and locking means connected to said connecting rods for preventing the collapse of said assembly.

23. The collapsible spring assembly of claim 22 wherein said locking means comprises at least one locking rod located in one of said planes, said locking rod being secured to said connecting rods in order to prevent the collapse of said assembly.

24. The collapsible spring assembly of claim 22 wherein said end sections of said module wires are secured to said connecting rods by helical lacing wires which encircle said connecting rods and said end sections of said module wires.

25. The collapsible spring assembly of claim 22 further comprising a plastic mesh secured to said connecting rods in at least one of said planes, said plastic mesh functioning to maintain said assembly in an expanded condition.

26. The collapsible innerspring assembly of claim 22 further comprising a wire net located in one of said planes on one of said surfaces of said assembly to prevent fabric from falling between said connecting rods.

27. The collapsible innerspring assembly of claim 22 wherein said locking rods are wrapped around said connecting rods to inhibit the lateral movement of said connecting rods.

28. A collapsible spring assembly comprising:

two parallel upper border rods extending in a first direction between which lie a plurality of connecting rods, said upper border rods and connecting rods lying substantially in a top plane, two parallel lower border rods extending in said first direction between which lie a plurality of connecting rods, said lower border rods and connecting rods lying substantially in a bottom plane, a plurality of collapsible modules extending between said planes, each of said modules being rotatable about a center axis and secured to said connecting rods, a locking mechanism secured to said border rods in order to hold said assembly in an assembled, expanded condition.

29. A collapsible spring assembly having an upper planar surface in a top plane and a lower planar surface in a bottom plane, said assembly comprising: a plurality of modules, each of said modules comprising more than one module wire, said module wires rotating about an axis located between said top plane and said bottom plane, said module wires being connected to connecting rods, said connecting rods being located in the top and bottom planes of said assembly.

30. The collapsible spring assembly of claim 29 wherein the width of said assembly is narrowed upon the collapse of said modules.

31. A method of manufacturing a collapsible spring assembly, said assembly having a longitudinal dimension and a transverse dimension said longitudinal dimension being greater than said transverse dimension, an upper planar surface in a top plane and a bottom planar surface in a bottom plane, a plurality of collapsible spring modules extending between said planes, said modules being secured to connecting rods, said connecting rods being in said planes between two opposed border rods, said method comprising:

expanding said spring assembly so as to increase the transverse dimension of said spring assembly; and securing locking means to aid opposed border rods to maintain said assembly in an expanded condition.

32. The method of claim 31 wherein expanding said spring assembly comprises pulling apart said border rods until said modules are the desired height.

33. A method of manufacturing a collapsible bedding assembly, said assembly when erected having an upper planar surface in a top plane and a parallel bottom planar surface in a bottom plane, said assembly when erected having a plurality of collapsible spring modules extending between said planes, said modules being secured to connecting rods, said connecting rods being in said top and bottom planes between two opposed border rods, said method comprising:

pulling said connecting rods apart from one another, expanding said spring modules, securing locking means to opposed border rods in said top and bottom planes to maintain said assembly in an expanded condition.

34. A method of manufacturing a collapsible bedding assembly, said assembly when erected having an upper planar surface in a top plane and a parallel bottom planar surface in a bottom plane, said assembly when erected having a plurality of collapsible spring modules extending between said planes, said method comprising:

expanding said spring modules in a transverse direction, securing locking means to opposed border rods in said top and bottom planes to maintain said assembly in an expanded condition.

* * * * *

UNITED STATES PATENT AND TRADEMARK OFFICE

CERTIFICATE OF CORRECTION

PATENT NO. : 5,765,240
DATED : June 16, 1998
INVENTOR(S) : Joe C. Workman

It is certified that error appears in the above-identified patent and that said Letters Patent is hereby corrected as shown below:

In the title, "THE TRANSVERSE" should be --ONE-- and "IT" should be --SAME--

Col. 11, line 15, after "transverse dimension" insert --,--

Col. 11, line 24, "aid" should be --said--

Col. 12, lines 2 and 17, after "having" insert --a longitudinal dimension and a transverse dimension, said longitudinal dimension being greater than said transverse dimension,--

Col. 12, line 12 , after "modules" insert --in a transverse direction--

Signed and Sealed this

Twenty-ninth Day of December, 1998

*Attest:*

*Attesting Officer*

Bruce Lehman

BRUCE LEHMAN

*Commissioner of Patents and Trademarks*